US006597882B1

(12) United States Patent
Tanaka

(10) Patent No.: US 6,597,882 B1
(45) Date of Patent: Jul. 22, 2003

(54) DEVELOPING APPARATUS

(75) Inventor: Yoshiaki Tanaka, Numazu (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/058,610

(22) Filed: Jan. 28, 2002

(51) Int. Cl.[7] ..... G03G 15/08
(52) U.S. Cl. ..... 399/258; 399/262
(58) Field of Search ..... 399/258, 360, 399/359, 358, 262

(56) References Cited

U.S. PATENT DOCUMENTS 4,849,791 A 7/1989 Hagihara et al.
5,398,098 A * 3/1995 Fukunaga et al. ..... 399/110

FOREIGN PATENT DOCUMENTS

JP 5-341639 A 12/1993
JP 9-218575 A 8/1997
JP 11-153904 A 6/1999

* cited by examiner

*Primary Examiner*—Quana M. Grainger
(74) *Attorney, Agent, or Firm*—Frishauf, Holtz, Goodman & Chick, P.C.

(57) ABSTRACT

A developing apparatus comprises a toner supply auger provided slidably along a shaft in a development case for transferring toner supplied from a toner supply inlet along the shaft to a transfer mixer, an open-and-shut device for opening and closing a toner supply outlet and a toner supply inlet, and a pushing means for moving the toner supply auger in the loading and unloading direction of the toner supply cartridge, thereby changing a site of the toner supply auger facing the toner supply inlet to another site near the back end of the toner supply auger.

7 Claims, 6 Drawing Sheets

DEVELOPING APPARATUS

BACKGROUND OF THE INVENTION

The present invention relates to a developing apparatus for use in an image forming apparatus such as an electrophotographic copier.

It is known that, in a developing apparatus, toner is supplied from a toner cartridge inserted into the apparatus and slidably attached on the upper surface of a developer case.

A toner supply outlet is formed in the bottom surface of the toner cartridge and a toner supply inlet is formed in the upper surface of the developer case. The toner supply outlet is opened and closed by a first shutter slidably attached to the bottom surface of the toner cartridge, whereas the toner supply inlet is opened and closed by a second shutter slidably attached to the upper surface of the developer case. Springs are provided to push the first and second shutters to close the toner supply outlet and inlet, respectively.

When the toner cartridge is loaded into the developer case along the upper surface, the first and second shutters are pushed against spring tension to release the toner supply outlet and inlet, respectively. Conversely, when the toner cartridge is unloaded from the developer case, the first and second shutters are pushed by spring tension to shut the toner supply outlet and inlet.

On the other hand, the toner cartridge houses a stirrer paddle for rotating and stirring toner to prevent coagulation. The developer case houses a toner supply auger in the developer case for transferring toner to a transfer mixer. The developer case further houses a transfer mixer, a concentration sensor, and a developing roller. The toner supplied by the toner supply auger is blended with carrier and transferred by the transfer mixer. The concentration of toner in the developing agent is detected by the concentration sensor.

When the concentration sensor detects that the toner concentration is equal to and lower than a predetermined value, the stirrer paddle initiates rotation to transfer toner. The toner is supplied from the toner supply outlet of the toner cartridge and introduced into the developer case through the toner supply inlet. The introduced toner in the developer case is transferred while being rotated by the supply auger and sent to the transfer mixer. The toner supply operation is continued until the concentration of toner (checked by the concentration sensor) reaches a predetermined value. The supplied toner is then transferred to the developing roller while being rotated by the transfer mixer.

The toner cartridge 2 must be exchanged when the toner cartridge 2 is empty or nearly empty as a result of toner being continuously supplied. Sometimes, however, the toner cartridge 2 must be exchanged even though it is not empty, for example, when the developing unit 1 is exchanged since the developing agent has ceased function, and when the photoconductive drum is exchanged since it has ceased function.

When toner completely runs out, toner leakage would not occur when the toner cartridge is exchanged since no toner is present in a toner supply passage from the toner cartridge to the supply auger.

However, when toner is contained in a toner cartridge, toner leaks since the toner supply passage is filled with toner. More specifically, when the toner cartridge is unloaded, the first and second shutters shut off the toner supply passage. Therefore, toner corresponding to at least the thickness of the shutters leaks out.

In an attempt to prevent toner from being scattered, a sealing material is usually attached to the shutter to tighten the shutter. With this, the thickness of the shutter tends to increase.

In most cases, the user performs the loading and unloading operation of a toner cartridge. However, even if toner leaks during the unload operation, the user rarely removes toner, unlike a service engineer. Therefore, the leaked toner attaches to electrically charged wire and to an optical lens, causing nonuniform electrification and bringing an adverse effect upon copy images, respectively.

BRIEF SUMMARY OF THE INVENTION

The present invention has been attained in consideration of the aforementioned problems. An object of the present invention is to provide a developing apparatus causing no toner leakage even if a toner cartridge is exchanged while containing toner in it.

According to the present invention, there is provided a developing apparatus comprising a developer case comprising a transfer mixer for mixing and stirring toner and carrier and transferring a toner-and-carrier mixture, a developing roller for supplying the toner transferred by the transfer mixer to an object to be developed, and a developer case having a toner supply inlet for introducing the toner;

a toner supply cartridge detachably attached to the developer case and having a toner supply outlet for supplying toner, toner being supplied from the toner supply outlet to the developer case through the toner supply inlet;

a toner supply auger slidably attached within the developer case along a shaft for transferring the toner supplied from the toner supply inlet along the shaft and sent to the transfer mixer;

an open-and-shut device for opening and closing the toner supply outlet and the toner supply inlet in accordance with loading and unloading of the toner supply cartridge; and tension-applying means for moving the toner supply auger in an unloading direction of the toner supply cartridge when the toner supply cartridge is unloaded, thereby changing a site of the toner supply auger facing the toner supply inlet to another site of the toner supply auger close to its back end.

According to the present invention, there is provided a developing apparatus comprising a developer case comprising a transfer mixer for mixing and stirring toner and carrier and transferring a toner-and-carrier mixture, a developing roller for supplying the toner transferred by the transfer mixer to an object to be developed, and a developer case having a toner supply inlet for introducing the toner;

a toner supply cartridge detachably attached to the developer case and having a toner supply outlet for supplying toner, toner being supplied from the toner supply outlet to the developer case through the toner supply inlet;

a toner supply auger slidably attached within the developer case along a shaft for transferring the toner supplied from the toner supply inlet along the shaft and sent to the transfer mixer;

an open-and-shut device for opening and closing the toner supply outlet and the toner supply inlet in accordance with loading and unloading of the toner supply cartridge, wherein the open-and-shut device comprises a first shutter for opening and closing the toner supply outlet and a second shutter for opening and closing the toner supply inlet, and the second shutter has a communication hole for communicating the toner supply outlet and the toner supply inlet, and width of the toner supply outlet, communication hole, and toner supply inlet increase in this order in a cartridge loading and unloading direction.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Now, embodiments of the present invention will be described in detail with reference to the accompanying drawings.

Figure 1:
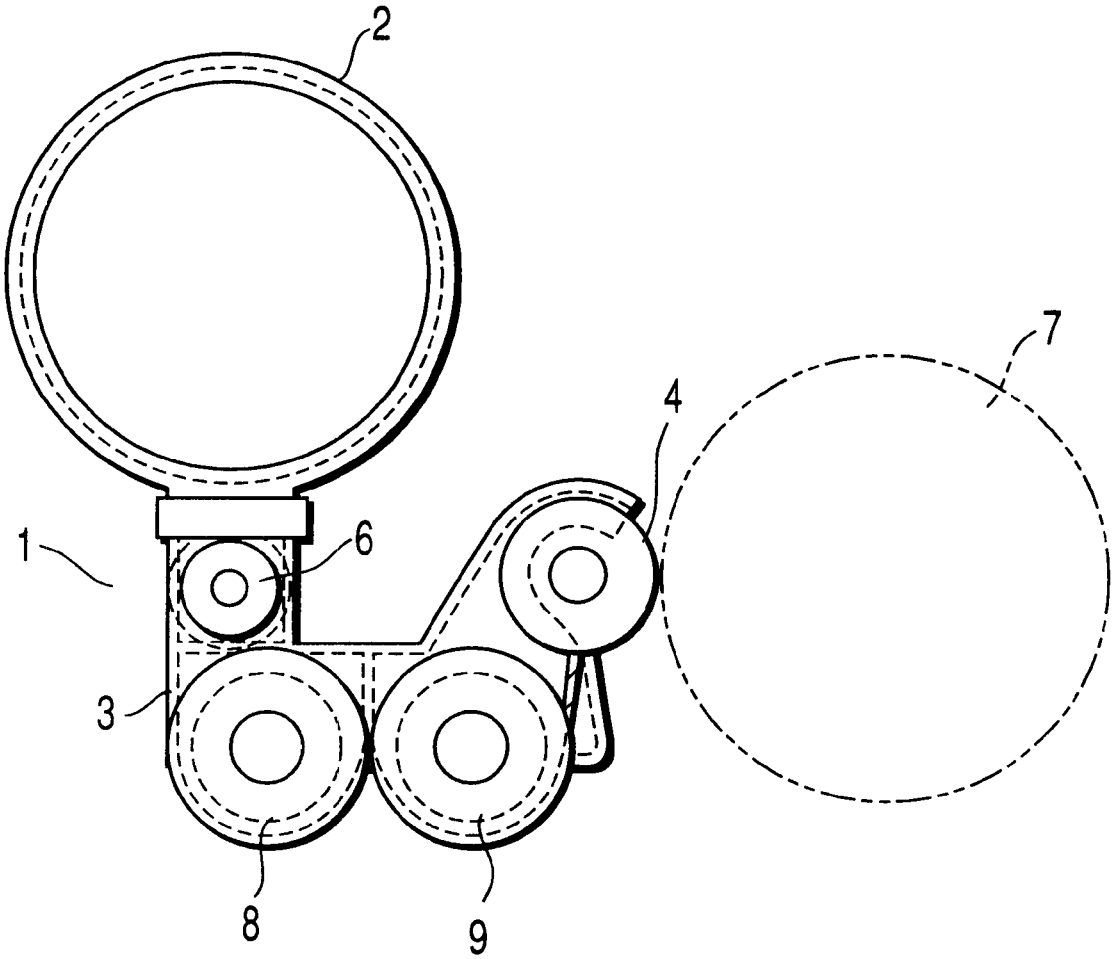
FIG. 1 is a front view of a developing apparatus according to an embodiment of the present invention.
Figure 2:
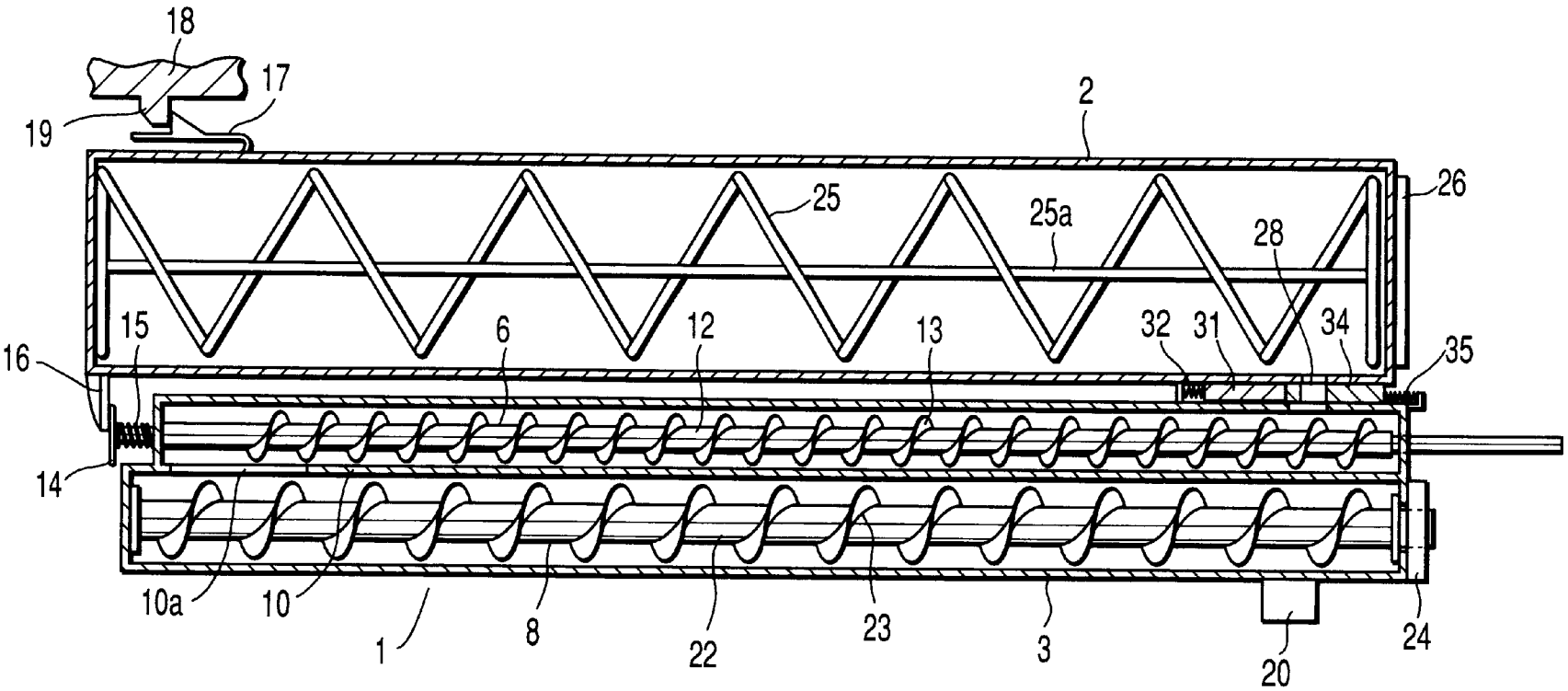
FIG. 2 is a sectional view showing a developing apparatus.

FIG. 1 is a front view of a developing apparatus according to an embodiment of the present invention. FIG. 2 is a sectional view of the developing apparatus.

The developing apparatus comprises a developing unit 1 and a toner cartridge 2. The toner cartridge 2 serves as a toner supplier and slidably attached to the upper surface of the developing unit 1.

The developing unit 1 has a developer case for storing a developing agent. In the upper portion of the developer case 3, a magnet roller 4 serving as a developing roller and a toner supply auger 6 are arranged. In the lower portion of the developer case 3, two transfer mixers 8 and 9 are rotatably arranged. The magnet roller 4 is arranged so as to face a photoconductive drum 7.

A partition board 10 is interposed between the toner supply auger 6 and the transfer mixer 8. A toner release port 10*a* for dropping toner is formed at the front side of the partition board 10. The lower portion of the partition board 10 is filled with a developing agent having toner and carrier previously mixed.

The toner supply auger 6 is formed of a shaft 12 and a spiral portion 13 attached to the shaft 12. The front and back ends of the shaft 12 are slidably supported respectively by front and back walls of the developer case 3 and protrude from the developer case 3. A handguard 14 is attached to the front-end portion of the shaft 12. A spring 15 is interposed between the handguard 14 and the front-end surface of the developer case 3. The shaft 12 is pushed frontward by the spring 15.

Figure 3:
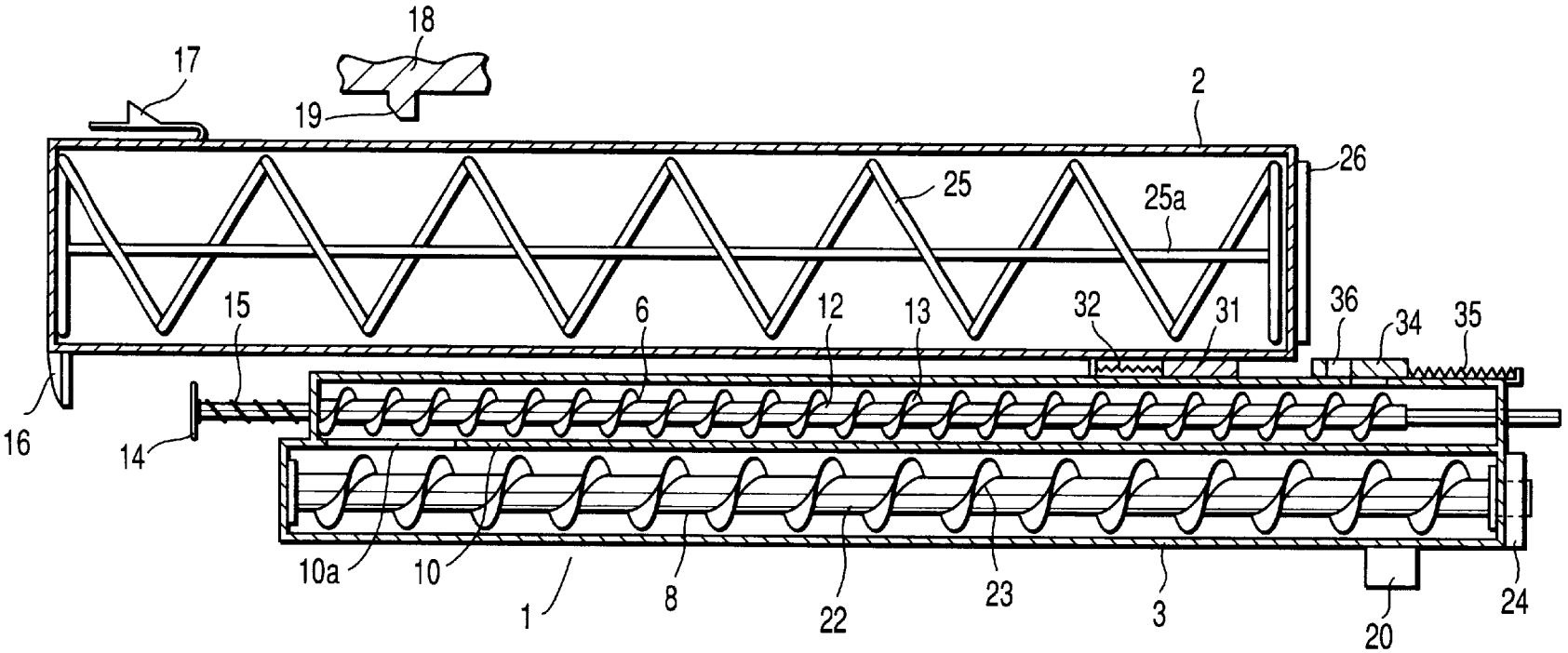
FIG. 3 is a view showing the state where a toner cartridge is pulled out from a developer case.

On the other hand, a projecting portion 16 is formed so as to protrude from the lower front end of the toner cartridge 2. The projecting portion 16 is in contact with the handguard 14 of the shaft 12. An elastic overhang latch piece 17 is formed at the upper front-end portion of the toner cartridge 2. The overhang latch piece 17 is designed to be detachably engaged with a stopper 19, which protrudes from a main body flame 18 of a copier. When the overhang latch piece 17 is engaged with the stopper 19, the toner cartridge 2 is prevented from being unloaded. Conversely, when the overhang latch piece 17 is released from the stopper 19, the toner cartridge 2 is unlocked and unloaded as shown in FIG. 3.

When the toner cartridge 2 is locked, the projecting portion 16 of the toner cartridge 2 pushes the overhang portion 14 of the toner supply auger 6 rearward against the tension of the spring 15. A concentration sensor 20 is provided at the lower surface of the developer case 3 at the rear side for detecting the concentration of toner.

The transfer mixers 8 and 9 each consists of a shaft 22 and a spiral portion 23 attached to the shaft 22. The rear end portion of the shaft 22 protrudes from the rear end portion of the developer case 3 and equipped with a driving gear 24.

Within the toner cartridge 2, a paddle 25 is rotatably provided for stirring toner. The rear end portion of the rotation shaft 25*a* protrudes from the rear end surface of the toner cartridge 2 and equipped with a driving gear 26. The driving gear 24 and driving gear 26 are rotated by driving mechanisms (not shown).

Figure 4:
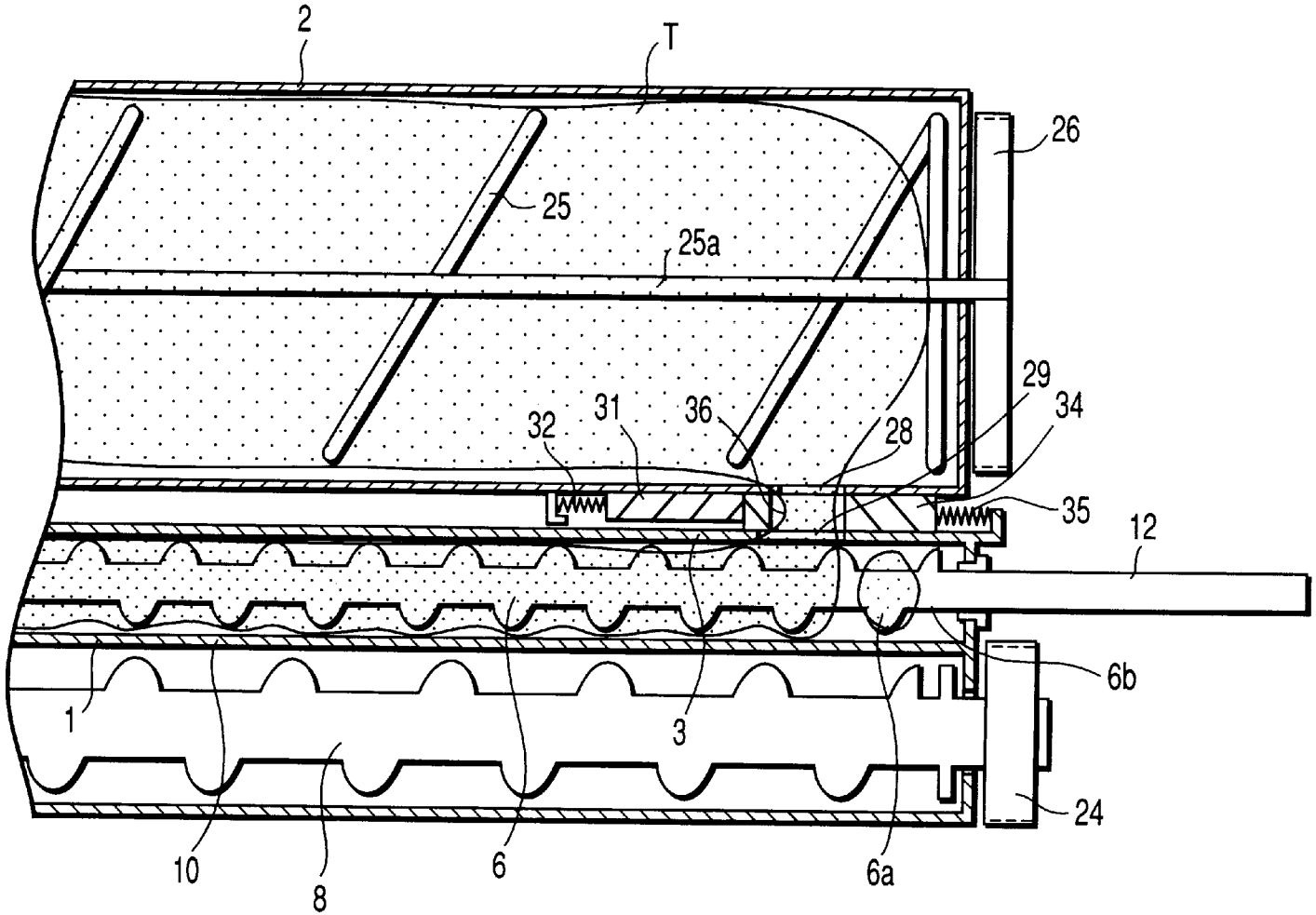
FIG. 4 is a magnified sectional view of a shutter.

FIG. 4 is a magnified sectional view of a toner supply passage from the toner cartridge 2 to the developing unit 1.

A toner supply outlet 28 is formed in the rear bottom of the toner cartridge 2. A toner supply inlet 29 is formed in the upper surface of the developer case 3 so as to face the toner supply outlet 28. A first shutter 31 for opening and closing the toner supply outlet 28 is slidably attached to the rear bottom of the toner cartridge 2. The first shutter 31 is pushed by a spring 32 attached to the toner cartridge 2 toward the rear of the toner cartridge 2.

A second shutter 34 for opening and closing the toner supply inlet 29 is slidably attached to the upper surface of the developer case 3. The second shutter 34 is pushed by a spring 35 attached to the upper surface portion of the developer case 3 toward the front of the developer case 3.

The second shutter 34 has a communication hole 36 for communicating the toner supply outlet 28 to the toner supply inlet 29.

The width (the size in the toner cartridge moving direction) of the toner supply outlet 28, the communication hole 36, and the toner supply inlet 29 increase in this order.

Now, the operation of the developing apparatus during a developing process will be described.

During the developing process, the transfer mixers 8 and 9 are rotated, thereby stirring a developing agent within the developer case 3 and transferring it to the magnet roller 4. Since a magnet force is applied to the developing agent supplied to the magnet roller 4, the developing agent acts as a magnet brush. When the magnet brush is brought into contact with a photoconductive drum 7, an electrostatic latent image is developed.

The concentration of toner supplied to the magnet roller 4 is detected by the concentration sensor 20. When the concentration sensor 20 detects that the concentration of toner is lower than a predetermined value, fresh toner is supplied from the toner cartridge 2.

Now, an operation for supplying toner will be described.

When toner is supplied, the paddle 25 in the toner cartridge 2 and the toner supply auger 6 in the developer case 3 are rotated, respectively. While stirring and transferring by the paddle 25, toner is supplied from the toner supply outlet 28 to the developer case 3 through the communication hole 36 of the second shutter 34 and the toner supply inlet 29 of the developer case 3.

The toner thus supplied is transferred frontward by the rotation of toner supply auger 6 and falls down through the toner dropping port 10*a* of the partition board 10. In this manner, toner is supplied to the toner mixer 8. The toner, when the transfer mixers 8 and 9 are rotated, is stirred, transferred and supplied to the magnet roller 4.

The toner cartridge 2 must be exchanged when the toner cartridge 2 is empty or nearly empty as a result of toner being continuously supplied. Sometimes, however, the toner cartridge 2 must be exchanged even though it is not empty, for example, when the developing unit 1 is exchanged since the developing agent has ceased function, and when the photoconductive drum is exchanged since it has ceased function.

Now, an operation for exchanging the toner cartridge 2 will be described.

Figure 6:
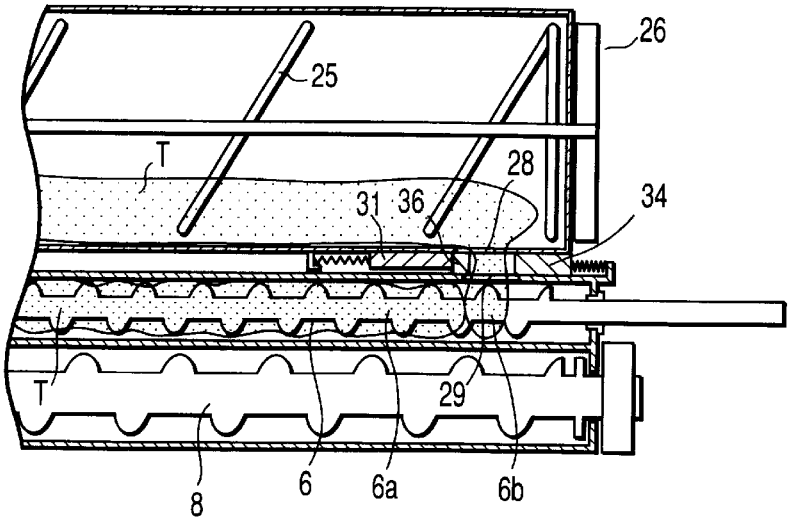
FIG. 6 is a view showing the state where the toner cartridge shown in FIG. 5 is pulled out.
Figure 7:
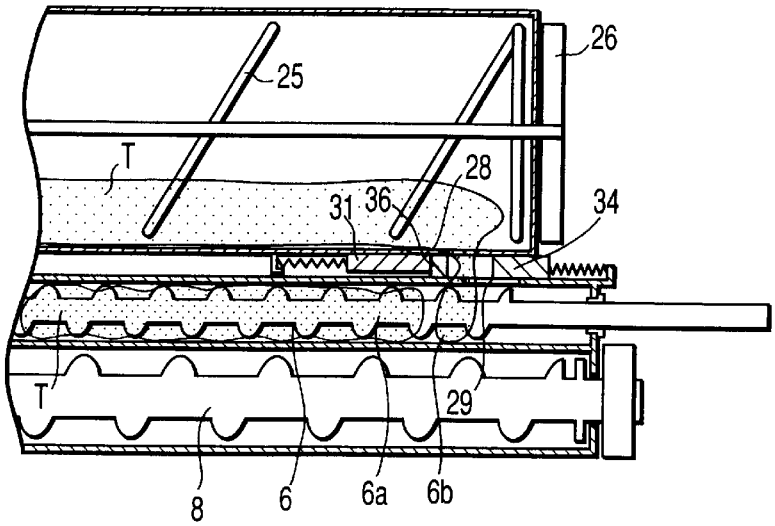
FIG. 7 is a view showing the state where the toner cartridge shown in FIG. 6 is pulled out.
Figure 8:
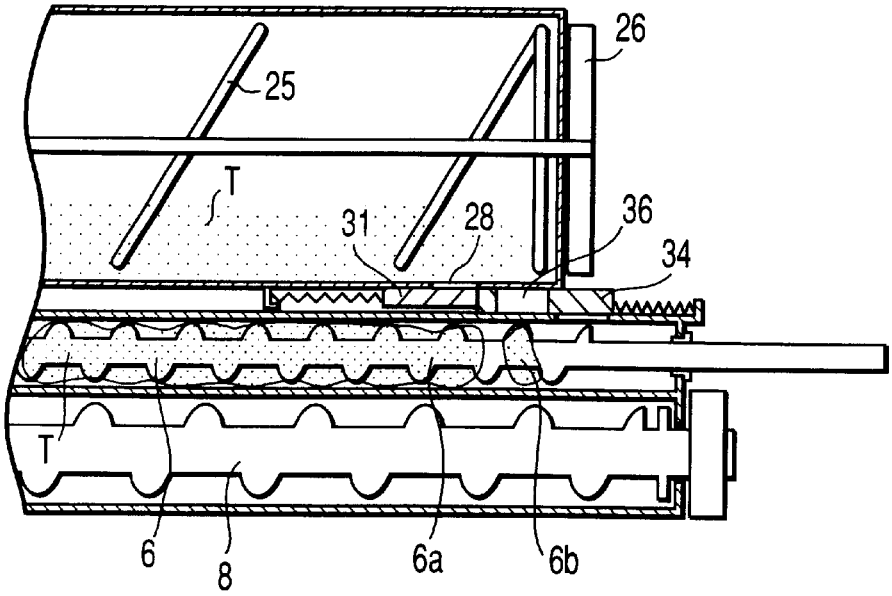
FIG. 8 is a view showing the state where the toner cartridge shown in FIG. 7 is pulled out.
Figure 9:
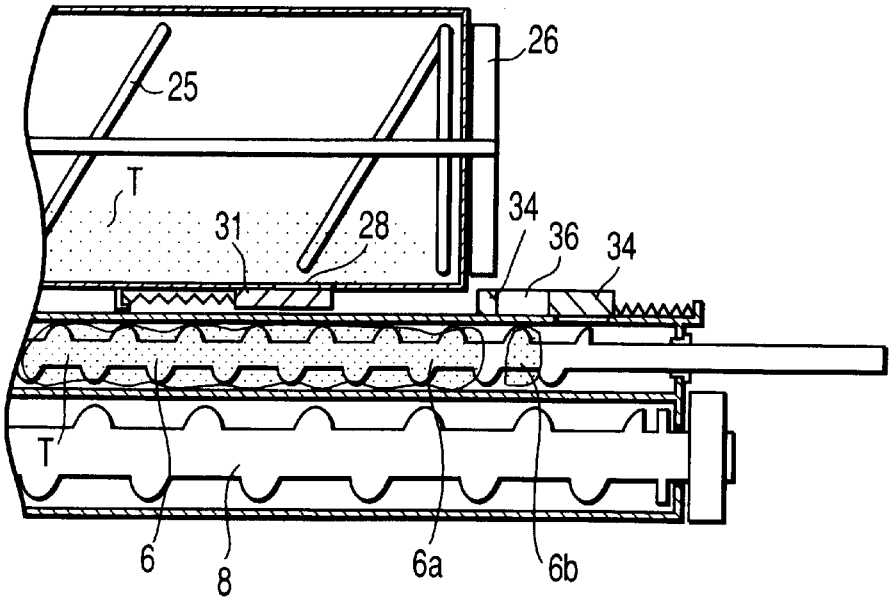
FIG. 9 is a view showing the state where the toner cartridge shown in FIG. 8 is pulled out and the toner supply outlet and toner supply inlet are closed.

In FIG. 2, the overhang latch piece 17 is released from the stopper 19 to unlock the toner cartridge 2 and thereafter the toner cartridge 2 is unloaded frontward. As a result, the projecting portion 16 of the toner cartridge 2 moves away from the handguard 14 of the toner supply auger 6 and the toner supply auger 6 is pushed frontward in a predetermined distance by the tension of the spring 15, as shown in FIG. 3. More specifically, the toner supply auger 6 shown in FIG. 5 moves frontward as shown in FIGS. 6 to 8. When the toner supply auger moves forward, springs 32 and 35 push the first and second shutters 31 and 34 to shut the toner supply outlet 28 and toner supply inlet 29, respectively, as shown in FIG. 9.

As the toner supply auger 6 moves frontward, the site of the toner supply auger 6 facing the toner supply inlet 29 changes, as shown in FIGS. 6 to 8. More specifically, the toner supply inlet 29 faces a site 6*a* of the toner supply auger 6 in FIG. 5. However, when the toner supply auger 6 moves to the position shown in FIGS. 6 to 8, the toner supply inlet 29 comes to face a site 6*b* of the auger near the back end.

Figure 5:
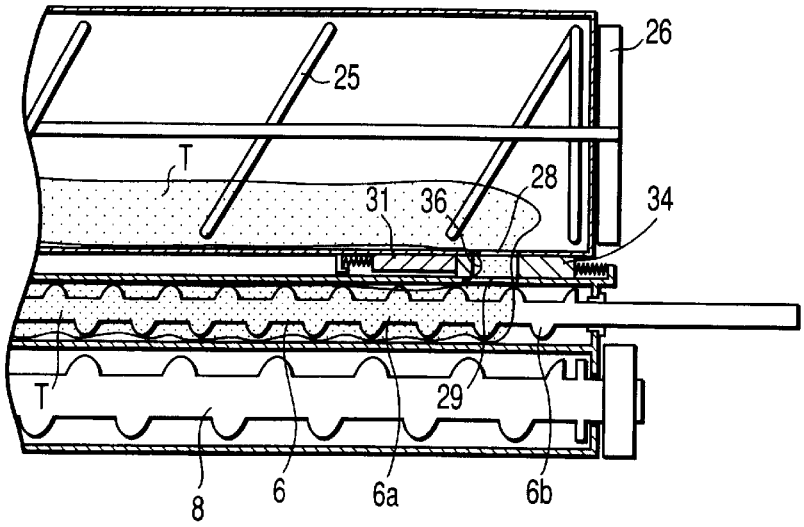
FIG. 5 is a view showing a toner cartridge attached to a developer case with the toner supply outlet of the cartridge communicating with the toner supply inlet of the developer case.

In FIG. 5, toner is present at the site 6*a* of the toner supply auger 6 but absent at the site 6*b*. Therefore, when the toner supply auger is positioned as shown in FIGS. 6 to 8, toner does not obstruct the toner supply outlet 29 and toner present in the communication hole 36 and the toner supply inlet 29 smoothly falls under its own weight and placed in the developing case 3. Therefore, unlike a conventional case, the shutter does not cut out toner, completely preventing toner from scattering outside.

After the toner cartridge 2 is taken off from the developing unit 1, a new toner cartridge 2 is loaded along the upper surface of the unit. Accordingly, the projecting portion 16 of the toner cartridge 2 comes into contact with the handguard 14 of the toner supply auger 6, which is pushed inside against the tension of the spring 15. At this time, the first and second shutters 31 and 34 move inside against the tension of springs 32 and 35, respectively. When the toner cartridge 2 is loaded to the end, the overhang latch piece 17 is engaged with the stopper 19 to lock the toner cartridge. At the same time, the first and second shutters 31 and 34 move to predetermined positions to release the toner supply outlet 28 and the toner supply inlet 29.

According to the embodiment, toner leakage from the toner supply passage can be completely prevented when the toner cartridge 2 is unloaded, thereby preventing nonuniform electrification and negative effects upon a copy image.

The width (the size in a cartridge moving direction) of toner supply outlet 28, the communication hole 36, and the toner supply inlet 29 increase in this order. Because of this feature, even if the second shutter 34 is not completely set at a predetermined position, the communication hole 36 is almost aligned with the toner supply port 29. As a result, toner falls within the developer case without fail.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A developing apparatus comprising:

a developer case comprising a transfer mixer for mixing and stirring toner and carrier and transferring a toner-and-carrier mixture, a developing roller for supplying the toner transferred by the transfer mixer to an object to be developed, and a developer case having a toner supply inlet for introducing the toner;

a toner supply cartridge detachably attached to the developer case and having a toner supply outlet for supplying toner, toner being supplied from the toner supply outlet to the developer case through the toner supply inlet;

a toner supply auger slidably attached within the developer case along a shaft for transferring the toner supplied from the toner supply inlet along the shaft and sent to the transfer mixer;

an open-and-shut device for opening and closing the toner supply outlet and the toner supply inlet in accordance with loading and unloading of the toner supply cartridge; and tension-applying device which moves the toner supply auger in an unloading direction of the toner supply cartridge when the toner supply cartridge is unloaded, thereby changing a site of the toner supply auger facing the toner supply inlet to another site of the toner supply auger close to its back end.

2. The developing apparatus according to claim 1, wherein said open-and-shut device comprises a first shutter for opening and closing the toner supply outlet and a second shutter for opening and closing the toner supply inlet.

3. The developing apparatus according to claim 2, wherein first and second pushing means pushes said first and second shutters to close the toner supply outlet and the toner supply inlet, respectively.

4. The developing apparatus according to claim 2, wherein said second shutter has a communication hole for communicating the toner supply port and the toner supply inlet.

5. The developing apparatus according to claim 1, wherein said toner supply auger is moved against tension of the pushing means as the toner supply cartridge is loaded.

6. A developing apparatus comprising:

a developer case comprising a transfer mixer for mixing and stirring toner and carrier and transferring a toner-and-carrier mixture, a developing roller for supplying the toner transferred by the transfer mixer to an object to be developed, and a developer case having a toner supply inlet for introducing the toner;

a toner supply cartridge detachably attached to the developer case and having a toner supply outlet for supplying toner, toner being supplied from the toner supply outlet to the developer case through the toner supply inlet;

a toner supply auger provided within the developer case for transferring toner supplied from the toner supply inlet along the shaft to the transfer mixer; and an open-and-shut device for opening and closing the toner supply outlet and the toner supply inlet in accordance with loading and unloading operation of the toner supply cartridge, wherein said open-and-shut device comprises a first shutter for opening and closing the toner supply outlet and a second shutter for opening and closing the toner supply inlet, and width of the toner supply outlet, communication hole, and toner supply inlet increase in this order in a cartridge loading and unloading direction.

7. The developing apparatus according to claim 6, wherein first and second pushing means push said first and second shutters to shut the toner supply outlet and the toner supply inlet.

* * * * *